United States Patent [19]

Ratzlaff

[11] 4,206,819

[45] Jun. 10, 1980

[54] DUMPING BULLDOZING ASSEMBLY FOR A FARM TRACTOR

[76] Inventor: Alvin E. Ratzlaff, Orienta, Okla. 73765

[21] Appl. No.: 928,119

[22] Filed: Jul. 26, 1978

[51] Int. Cl.[2] ..... A01B 3/76

[52] U.S. Cl. ..... 172/801; 172/809

[58] Field of Search ..... 172/804, 809, 808, 801

[56] References Cited

U.S. PATENT DOCUMENTS

| | | | |
|---|---|---|---|
| 2,404,760 | 7/1946 | Washbond | 172/801 |
| 2,446,136 | 7/1948 | Jarmin | 172/809 |
| 2,565,337 | 8/1951 | Allan | 172/804 |
| 3,296,721 | 1/1967 | Coontz | 172/801 |
| 3,403,802 | 10/1968 | Lundell | 37/117.5 X |
| 3,487,884 | 1/1970 | Volberding | 172/809 X |

FOREIGN PATENT DOCUMENTS

| | | | |
|---|---|---|---|
| 633863 | 1/1962 | Canada | 172/801 |

*Primary Examiner*—Richard J. Johnson

*Attorney, Agent, or Firm*—Robert K. Rhea

[57] ABSTRACT

A bulldozing assembly for a row crop farm tractor comprising a pair of push rods pivotally connected in lateral spaced relation to the rearward lower central portion of a bulldozing blade disposed transversely of the forward end of the tractor and pivotally connected at their rearward ends to the drawbar of the tractor. A pair of forwardly projecting braces, connected to opposing sides of the tractor frame, are connected by pivoting links to the upper rearward surface of the bulldozing blade to tilt the upper edge portion of the blade to a forwardly disposed unloading position in response to lifting the blade by pressure cylinders extending between the blade and braces.

3 Claims, 3 Drawing Figures

DUMPING BULLDOZING ASSEMBLY FOR A FARM TRACTOR

BACKGROUND OF THE INVENTION

1. Field of the Invention

The present invention relates to bulldozer implements and more particularly to a bulldozing assembly to be mounted at the forward end of a wide axle wheeled row crop farm tractor.

Bulldozers have generally comprised a prime mover having a transversely mounted forward blade arranged for powered movement in a tilting or angled relation for scraping, loading and unloading earth in a pushing and/or lifting action. It is desirable that a bulldozing assembly be provided for temporary attachment to a farm type tractor so that the operator may perform bulldozing work without the necessity of employing or purchasing a heavy duty type bulldozer unit.

2. Description of the Prior Art

One example of a tractor connected bulldozing assembly is disclosed by U.S. Pat. No. 3,487,884 which transversely mounts a dozer blade at the forward end of a tractor by a pair of longitudinal push arms connected with the rearward end of the tractor and further includes upright standards on the back of the blade pivotally connected with tractor mounted operating arms through a rock shaft to control the position of the blade during bulldozing operation by hydraulic cylinders.

This invention is distinctive over the above named patent by pivoting links connected with the upper edge portion of the blade which automatically tilts the upper edge of the blade forwardly of its lower edge in response to vertical lifting of the blade.

SUMMARY OF THE INVENTION

A bulldozing blade is transversely disposed forwardly of a tractor. A pair of elongated push rods are pivotally connected at their forward ends in lateral spaced relation to the central lower edge portion of the bulldozing blade and pivotally connected at their rearward ends to the frame or drawbar of the tractor. A pair of forwardly and upwardly projecting braces are rigidly connected to opposing sides of the forward end of the tractor frame. A pair of links extend between and are respectively pivotally connected in laterally spaced relation at their respective ends to the rearward surface of the upper edge portion of the bulldozing blade and the forward end portion of the braces. A stop, on the respective brace when contacted by the links, prevents rearward swinging movement of the upper portion of the blade beyond a predetermined limit. Pressure cylinders, extending between and pivotally connected, respectively, with the braces and the lower portion of the blade and raise and lower the blade toward and away from the surface of the earth. When the blade is lifted, the pivoting links tilt the upper edge limit of the blade forwardly to a position at least equal with or intersecting a vertical plane coinciding with the lowermost edge of the blade.

The principal object of this invention is to provide a bulldozing assembly for connection with a row crop farm tractor which automatically tilts the dozer blade to a blade unloading position in response to a lifting action applied to the blade.

DESCRIPTION OF THE PREFERRED EMBODIMENT

Figures 1, 2, 3:
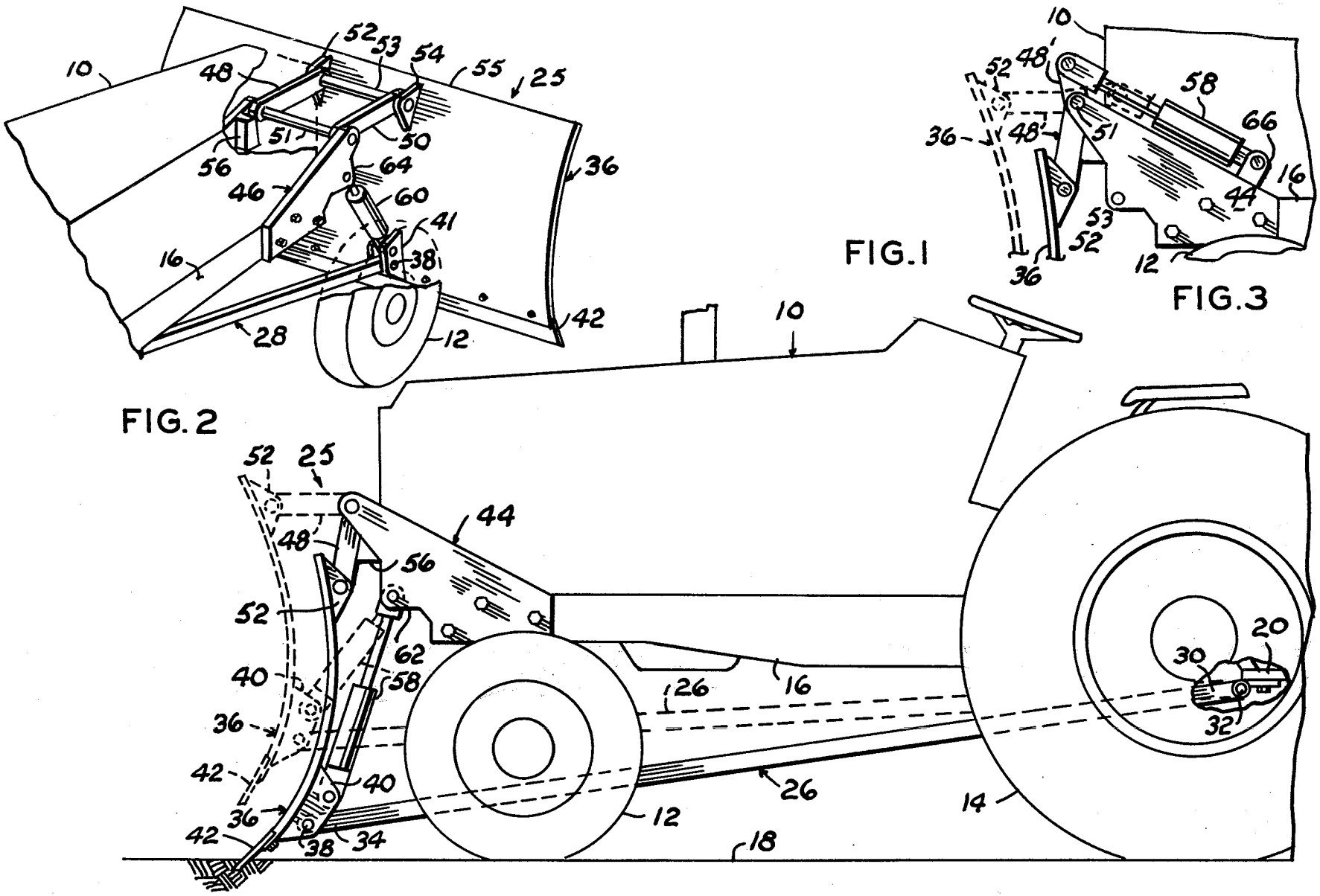
FIG. 1 is a side elevational view of the bulldozing assembly in operative position when connected with a farm tractor, shown in fragmentary outline, with parts broken away for clarity and illustrating the assembly in blade unloading position by dotted lines.
FIG. 2 is a fragmentary perspective view from the rearward side of the bulldozing assembly when in blade lifted position, portions of the tractor being broken away and omitted for clarity; and, FIG. 3 is a fragmentary elevational view illustrating another manner of mounting the blade lifting cylinder.

Like characters of reference designate like parts in those figures of the drawings in which they occur.

In the drawings:

The reference numeral 10 indicates a conventional farm tractor commonly referred to as the wide axle row crop type having forward and rearward wheels 12 and 14 respectively supporting the tractor frame 16 in elevated relation with respect to the surface of the earth, indicated by the line 18, so that the tractor may be driven between rows of farm crops with miminal damage thereto.

The tractor is provided with a drawbar 20 connected with its rear axle portion in a conventional manner. The tractor further includes a hydraulic system not shown.

The numeral 25 generally indicates a bulldozing blade assembly which is removably connected with the tractor 10. The assembly 25 includes a pair of elongated push rods 26 and 28 which may be metallic bars or may be tubular in the interest of weight reduction. The push rods 26 and 28 are longitudinally disposed in generally parallel relation below the tractor frame 16 and between the respective pairs of wheels. The rearward end portion 30 of each push rod is pivotally connected, as by a hinge and removable pins 32, with the tractor drawbar to provide a low center of gravity and permit the push rods to be vertically pivoted about the horizontal axis of the hinge pins 32. The forward end portions 34 of the push rods are pivotally connected to a bulldozing blade 36 by a pair of pivot pins 38 respectively extending between pairs of plates 40 and 41 secured in lateral spaced relation to the central lower rearward surface of the blade. The blade 36 is substantially conventional and is disposed transversely of the forward end of the tractor and, in the example shown, is arcuately curved rearwardly and upwardly from its depending edge which is provided with a removable coextensive cutting plate 42. The respective pairs of plates 40 and 41 are disposed in upright side by side parallel relation normal to the rearward surface of the blade.

A pair of plate-like brace members 44 and 46 are respectively secured to opposing sides of the forward end portion of the tractor frame 16 and project upwardly and forwardly beyond the forward limit of the tractor. A pair of links 48 and 50 are rigidly connected, at one end portion to the respective end portion of a torsion bar 51 pivotally supported by the forward end portion of the respective brace arm. The other end portion of the links 48 and 50 are rigidly connected with the respective end portion of another torsion bar 53 pivotally supported between cooperating ears 52 and 54 similarly secured in laterally spaced-apart relation to the upper rearward surface of the blade 36 adjacent its upper edge 55. The links 48 and 50 thus support the upper portion of the blade and maintain the blade against rearward movement of its upper portion beyond a predetermined position by contact of the respective link with a stop 56, only one being shown, secured to the respective brace 44 and 46 adjacent its upper end and on that side facing the tractor.

The blade 36 is raised and lowered by a pair cf hydraulic cylinders 58 and 60 connected with the tractor hydraulic system. The hydraulic cylinders are pivotally connected, respectively, at one end between the respective pair of plates 40 and 41 and pivotally connected at their other end, respectively, with lugs 62 and 64 integral with the respective brace 44 and 46.

As shown by FIG. 3, the hydraulic cylinders may be mounted on the brace arms 44 and 46 for lifting the blade 36. The cylinder end of the hydraulic cylinder 58 is connected by an ear 66 to the depending end portion of the upper edge of the brace 44 with the end of its piston rod pivotally connected with a link extension 48' projecting beyond the connection of the link 48 with the torsion bar 51 wherein hydraulic cylinder piston rod retraction lifts the blade 36 to its dotted line soil dumping position.

Operation

In operation, the dozer blade 36 is disposed with its cutting blade 42 adjacent or penetrating the surface of the earth a desired depth by the hydraulic cylinders 58 and 60. As the tractor is moved in a forward direction the push rods 26 and 28 apply the force of the tractor to the depending edge portion of the blade 36. When collected earth, not shown, adjacent the forward edge of the blade 36, is to be released or dumped the hydraulic cylinders 58 and 60 are operated to lift the blade to the dotted line position of FIG. 1 wherein the links 48 and 50 and torsion bars 51 and 53, by pivoting about their respective pivotally connected ends, tilt the upper portion of the blade in a forward direction so that the upper longitudinal edge 55 of the blade 36 is disposed at least parallel with a vertical plane coinciding with the lower edge of the cutter blade 42. The earth adjacent the forward surface of the tractor dozer blade then falls by gravity away from the blade.

The purpose of the torsion bars 51 and 53 and their rigid connection with the links 48 and 50 is to stabilize the horizontal position of the blade 36 which permits the use of only one of the hydraulic cylinders 58 or 60, if desired.

The dozer blade assembly 25 may be removed from the tractor by disconnecting the push rods 26 and 28 from the drawbar and removing the brace members 44 and 46.

Obviously the invention is susceptible to changes or alterations without defeating its practicability. Therefore, I do not wish to be confined to the preferred embodiment shown in the drawings and described herein.

I claim:

1. A bulldozing assembly in combination with a row crop type farm tractor having a frame supported by pairs of forward and rearward wheels and having a drawbar, the improvement comprising:

a bulldozing blade transversely disposed forwardly of said tractor;

a pair of push rods extending longitudinally of said tractor between said wheels;

means pivotally connecting the respective end portions of said rods with said blade and said drawbar for vertical swinging movement of their forward end portions about a horizontal axis;

a pair of brace members connected with opposing sides of said frame and projecting upwardly and forwardly therefrom;

a pair of normally generally vertically disposed links extending between and pivotally connected, for vertical swinging movement, at their respective ends with the forward upper end portion of said braces and said blade; and, a pair of hydraulic cylinders connected with said braces and said blade for lowering and raising said blade toward and away from the surface of the earth while simultaneously pivoting said pair of links forwardly to a generally horizontal position and automatically tilting the upper edge portion of said blade forwardly to a blade unloading position.

2. The combination according to claim 1 and further including:

stop means supported by each said brace for preventing rearward swinging movement of said links beyond a predetermined limit.

3. The combination according to claim 2 in which said pivotally connecting means includes:

pairs of plates secured to the central rearward lower portion of said blade in vertically disposed edgewise laterally spaced parallel relation for receiving the respective forward end portion of said push rods therebetween;

a pivot pin extending transversely through the respective pair of said plates; and, a horizontally disposed hinge pin secured to said drawbar.

* * * * *